US008641380B2

(12) United States Patent
McKenzie

(10) Patent No.: US 8,641,380 B2
(45) Date of Patent: Feb. 4, 2014

(54) COMPRESSOR WHEEL

(75) Inventor: David McKenzie, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 12/731,741

(22) Filed: Mar. 25, 2010

(65) Prior Publication Data

US 2010/0319344 A1 Dec. 23, 2010

Related U.S. Application Data

(63) Continuation of application No. 11/803,206, filed on May 14, 2007, now abandoned, which is a continuation of application No. PCT/GB2005/004316, filed on Nov. 9, 2005.

(30) Foreign Application Priority Data

Nov. 13, 2004 (GB) ..... 0425088.2

(51) Int. Cl.
*F01D 5/04* (2006.01)

(52) U.S. Cl.
USPC ..... 416/185

(58) Field of Classification Search
USPC ..... 416/185, 213 R, 244 A
See application file for complete search history.

(56) References Cited

U.S. PATENT DOCUMENTS

| | | | | |
|---|---|---|---|---|
| 4,335,997 | A * | 6/1982 | Ewing et al. | 416/185 |
| 4,705,463 | A | 11/1987 | Joco | |
| 4,787,821 | A * | 11/1988 | Cruse et al. | 416/185 |
| 4,850,802 | A * | 7/1989 | Pankratz et al. | 29/889.2 |
| 4,863,349 | A | 9/1989 | Arkhipov et al. | |
| 4,944,660 | A | 7/1990 | Joco et al. | |
| 5,158,435 | A | 10/1992 | Eardley | |
| 5,826,453 | A | 10/1998 | Prevey | |
| 6,164,931 | A * | 12/2000 | Norton et al. | 417/407 |
| 6,481,970 | B2 * | 11/2002 | Mukherjee et al. | 416/244 A |
| 6,755,065 | B2 | 6/2004 | Ostertag | |
| 2003/0136001 | A1 * | 7/2003 | Nishiyama et al. | 29/889.21 |
| 2004/0057834 | A1 * | 3/2004 | Shimizu | 416/244 A |
| 2004/0115071 | A1 | 6/2004 | Billington | |
| 2005/0056013 | A1 | 3/2005 | Furman et al. | |

FOREIGN PATENT DOCUMENTS

| | | |
|---|---|---|
| CN | 1499083 A | 10/2003 |
| DE | 10243415 A1 | 4/2004 |
| JP | 58-150098 | 9/1983 |

(Continued)

OTHER PUBLICATIONS

Callister, William D., Materials Science and Engineering: An Introduction, 1997, John Wiley & Sons, Inc., 4th Edition, pp. 163-165; 344-346.

(Continued)

*Primary Examiner* — Richard Edgar

(74) *Attorney, Agent, or Firm* — Krieg DeVault LLP; Clifford W. Browning

(57) ABSTRACT

A compressor wheel (7) is disclosed comprising an array of blades (20) extending from central hub (21) adapted from attachment to a rotatable shaft (8) and a backface (25). A region of the surface of the compressor wheel backface (25) is formed with a layer of residual compressive stress (26, 27).

29 Claims, 3 Drawing Sheets

(56) References Cited

FOREIGN PATENT DOCUMENTS

| | | | | |
|---|---|---|---|---|
| JP | 06093871 | A | * | 4/1994 |
| JP | 09-195987 | | | 7/1997 |
| JP | 2000-018192 | | | 1/2000 |
| JP | 2000018191 | A | * | 1/2000 |
| JP | 2001-304182 | | | 10/2001 |
| WO | WO2004078277 | | | 9/2004 |
| WO | WO2005/083269 | A | | 9/2005 |

OTHER PUBLICATIONS

International Search Report and Written Opinion, PCT/G62005/004316, Holset Engineering Company Limited, International Searching Authority/European Patent Office, Sep. 3, 2006.

International Preliminary Report on Patentability, PCT/GB2005/004316, Holset Engineering Company Limited, The International Bureau of WIPO, May 15, 2007.

Kigelstrahl-Anwendungen, 4th Edition 2002, Metal Improvement Company, Inc., see English translation of p. 25.

* cited by examiner

COMPRESSOR WHEEL

The present application is a continuation of U.S. application Ser. No. 11/803,206, filed on May 14, 2007, now abandoned which is a continuation of PCT/GB2005/004316 filed on Nov. 9, 2005, which claims the benefit of United Kingdom Patent Application No. GB0425088.2, filed Nov. 13, 2004. Each of the above applications is incorporated herein by reference.

The present invention relates to a compressor wheel and to an assembly of a compressor wheel mounted on a rotating shaft. Particularly, but not exclusively the present invention relates to the compressor wheel assembly of a turbocharger.

Turbochargers are well known devices for supplying air to the intake of an internal combustion engine at pressures above atmospheric (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the intake manifold of the engine, thereby increasing engine power. The shaft is supported on journal and thrust bearings located within a central bearing housing connected between the turbine and compressor wheel housings.

A conventional compressor wheel comprises a front face comprising an array of blades extending from a central hub and a rear face (commonly referred to within the turbocharger industry as the "backface"). The central hub is provided with a bore for receiving one end of the turbocharger shaft.

Aluminium alloys are commonly used for manufacturing compressor wheels although for some applications, particularly high-pressure ratio compressors which have higher operating temperatures, titanium alloys, ceramics or super alloys may be preferred. For the automotive industry casting is the preferred method of manufacture for cost-effectiveness. Alternatively the compressor wheel may be formed by machining from a solid billet.

As mentioned above, the turbocharger shaft is conventionally supported by journal and thrust bearings, including appropriate lubricating systems, located within a central bearing housing connected between the turbine and compressor wheel housings, m a conventional turbocharger design, the shaft passes from the bearing housing to the compressor housing through an appropriate passage in a compressor housing back plate, or oil seal plate, with a thrust bearing assembly located adjacent the plate within the bearing housing. To prevent oil leaking into the compressor housing, it is conventional to incorporate in such thrust bearing assemblies a seal assembly including an oil control device (often referred to within the turbocharger industry as an "oil slinger"). An oil slinger is a component which rotates with the shaft and comprises a radially extending surface for slinging oil away from the shaft and in particular away from the passage from the bearing housing into the compressor housing. An annular splash chamber located around the thrust bearing and sealing assembly collects the oil for re-circulation within the lubrication system. An oil slinger may be either a discrete component or an integral part of another component such as a part of a thrust bearing and/or sealing assembly.

Modern demands on turbocharger performance require increased airflow from a turbocharger of a given size, leading to increased rotational speeds, for instance in excess of 100,000 rpm. Increasing speeds make the use of lighter weight materials such as aluminium and titanium alloys desirable so as to reduce the rotating inertial mass of the compressor.

However, increasing speeds have also resulted in increasing loads being applied to the compressor wheel at transient operating conditions.

Thus, it is important to consider the loading and fatigue effects on a compressor wheel in order to ensure that it will be able to operate at the desired rotational speeds while having sufficient reliability throughout its intended lifespan. Analysis shows that the hub bore is a highly stressed region of a compressor wheel. For instance, as disclosed in U.S. Pat. No. 6,164,931 it has been suggested that the hub bore could be treated to reduce surface defects by creating residual compressive stresses at the inner circumference of the bore. An alternative approach, disclosed in U.S. Pat. No. 6,481,970, is to reduce the radial bore stresses by providing an interference fit insert sized so as to provide a predetermined prestressing of the hub bore.

However, despite such proposals the applicant has still found compressor wheel failure to be a problem. In particular the applicant has found an unexpectedly high number of early life compressor wheel failures.

It is an object of the present invention to obviate or mitigate the above problem.

According to the present invention there is provided a compressor wheel, the compressor wheel having an axis of rotation and comprising a plurality of blades extending generally radially away from said axis and generally axially from one face of a disc-like support, the opposite face of the support defining a wheel backface, wherein at least a portion of the backface is provided with a layer of residual compressive stress extending to a depth below the surface of the backface.

The applicant has found that a surprisingly significant proportion of compressor wheel failures, including early life failures, occur due to crack initiation on the compressor wheel backface. Such cracks subsequently propagate until resulting in a critical failure. Such failures are unexpected as they are not consistent with stress analysis of the compressor wheel which shows that the backface of a compressor wheel is, in fact, a relatively low stressed region of the compressor wheel.

The applicant has identified two factors which appear to be particularly significant in the initiation of backface originating failures.

Production quality is carefully controlled so as to minimise 3D defects in compressor wheels. However, surprisingly the applicant has now found that even seemingly minor and insignificant 2D skin defects, which would not normally be considered to fall outside of the manufacturing quality requirements, increase the likelihood of early life failure of compressor wheels.

Secondly, a number of failures have been caused by cracks that are initiated at the interface between the compressor backface and the oil slinger component. The failures appear to originate at the outside diameter of an indent left on the backface by the outside diameter of the oil slinger. The failures are characterised by a circumferential crack forming which initially penetrates forwards into the impeller due to the applied radial stresses. As the hoop stresses become dominant the crack changes direction and continues to grow in a radial direction until fracture occurs, ultimately resulting in the compressor wheel splitting.

In principle at least some failure modes may be compensated for by modification of the compressor wheel design. For instance, lengthening of the backface could be expected to redistribute the stresses and help alleviate failure at the slinger interface by separating the contact stresses from the peak stress at the hub bore. However, lengthening of the backface would require redesign of other compress/turbocharger features, which would be expensive and in many cases not possible due to constraints on the overall size of the compressor.

As mentioned in the introduction to this specification, it is known that the formation of a layer of residual compressive stress can improve fatigue life in a variety of materials. However, the failure modes identified by the applicant who would not generally be thought of as "fatigue" related failures. For instance, these failures can occur at any point in the compressor wheel life span and indeed may be particularly problematic in giving rise to early-life failures. However, the applicant has found that formation of a layer of residual compressive stress is effective in reducing the effects of the failure modes discussed above. In general, formation of a layer of residual compressive stress has been found to inhibit the formation of cracks in the backface and to impede the propagation of any cracks which do still form and which could otherwise lead to a critical failure. It appears that formation of the residual compressive stress layer modifies local stresses in the surface where any existing minor defect is present. This reduces the sensitivity of the wheel to such seemingly insignificant effectively two-dimensional skin defects, which would not normally be considered to fall outside of acceptable manufacturing tolerances, but which had been shown by the applicant to lead to failure. The layer of residual compressive stress may cover substantially the entire backface of the compressor wheel, or may be applied only where potential formation of cracks is seen to be a particular problem.

In one preferred embodiment the layer of residual compressive stress covers at least a portion of the backface of the compressor wheel which, in use, interfaces with a component of the compressor wheel assembly. The component may for instance comprise a component of the thrust bearing assembly typically including an oil control device such as an oil slinger.

This embodiment is for instance advantageous in preventing failures which initiate at the interface of the oil slinger and compressor wheel. In addition to inhibiting crack formation and propagation, a residual compressive layer decreases the likelihood of indentation at the outside diameter of the oil slinger which may otherwise increase the likelihood of crack initiation.

One problem that the applicant has recognised when forming a layer of residual compressive stress is that certain regions of the backface are susceptible to deformation under the mechanical forces required. For example, the backface may deform at the outer edges of the compressor wheel or at profiled regions of the backface. Thus, in a preferred embodiment the magnitude of the layer of residual compressive stress is reduced in at least one selected region of the backface to prevent deformation of the wheel in the selected region.

The compressor wheel will in use be attached to a rotatable shaft. The transition region between the shaft and the wheel may comprise a region formed with the layer of residual compressive stress. For instance, the wheel may be welded to the shaft, for example by friction welding with a transition region between the wheel and shaft comprising a fillet radii.

Thus, another aspect of the present invention provides a compressor wheel assembly, comprising a compressor wheel welded to a shaft for rotation about an axis, the compressor wheel comprising a plurality of blades extending generally radially away from said axis and generally axially from one face of a disc-like support, the opposite face of the support defining a wheel backface, wherein a transition region is defined between the backface and shaft in the region of said weld, said transition region being provided with a layer of residual compressive stress extending a depth below the surface of the backface.

The invention also provides a method of manufacturing a compressor wheel to provide increased resistance to critical failure, the compressor wheel having an axis of rotation and comprising a plurality of blades extending generally radially away from said axis and generally axially from one face of a disc-like support, the opposite face of the support defining a wheel backface, wherein at least a portion of the backface is treated to form a layer of residual compressive stress extending to a depth below the surface of the backface.

The layer of residual compressive stress is preferably formed by applying a cold working technique to the region. Several cold working techniques for forming a layer of residual compressive stress are known for improving fatigue life of a variety of materials and include burnishing, shot peening, gravity peening and laser shock peening. The inventors have found that these methods are also useful for forming a layer of compressive stress in accordance with the present invention. In a preferred embodiment of the invention the layer of compressive stress is induced by roller burnishing.

In preferred embodiments of the present invention the layer is formed with a greater depth then is typically the case when addressing fatigue issues as in the prior art where depths of the order of 200 μm are conventional. In preferred embodiments of the invention the layer is formed to a maximum or even average, depth of greater than 300 μm. Preferably the layer has a depth of at least 500 μm. In other preferred embodiments the layer may be even deeper with a maximum depth of greater than 800 μm or even 1 mm.

Although compressor wheels in accordance with the present invention may have many varied applications they are particularly suitable for incorporating in a turbocharger. Therefore, the preferred embodiment provides a turbocharger comprising the compressor wheel of the present invention mounted to a rotatable shaft for rotation within a compressor housing and a turbine wheel mounted to the other end of the rotatable shaft for rotation within a turbine housing.

Other advantageous and preferred features of the invention will become apparent from the description below.

Specific embodiments of the present invention will now be described, by way of example only, with reference to the accompanying drawings, in which.

Figure 3:
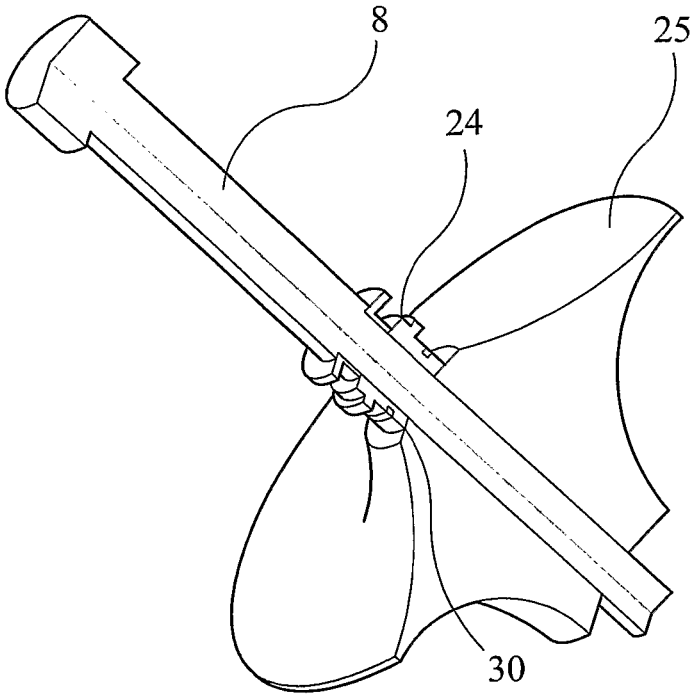
Figure 4:
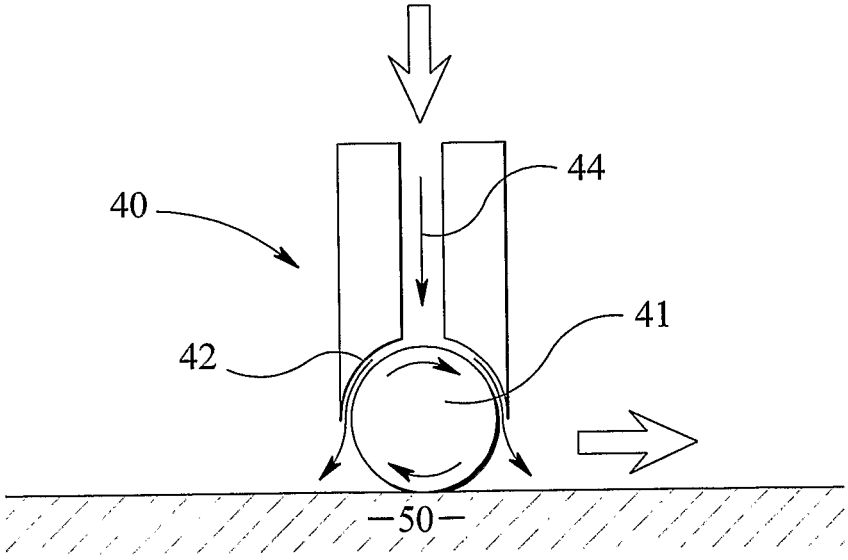

FIG. 3 schematically illustrates the oil slinger interface failure mode of a compressor wheel, which the preferred embodiment is believed to alleviate; and FIG. 4 illustrates a roller burnishing tool suitable for use with the present invention.

Figure 1:
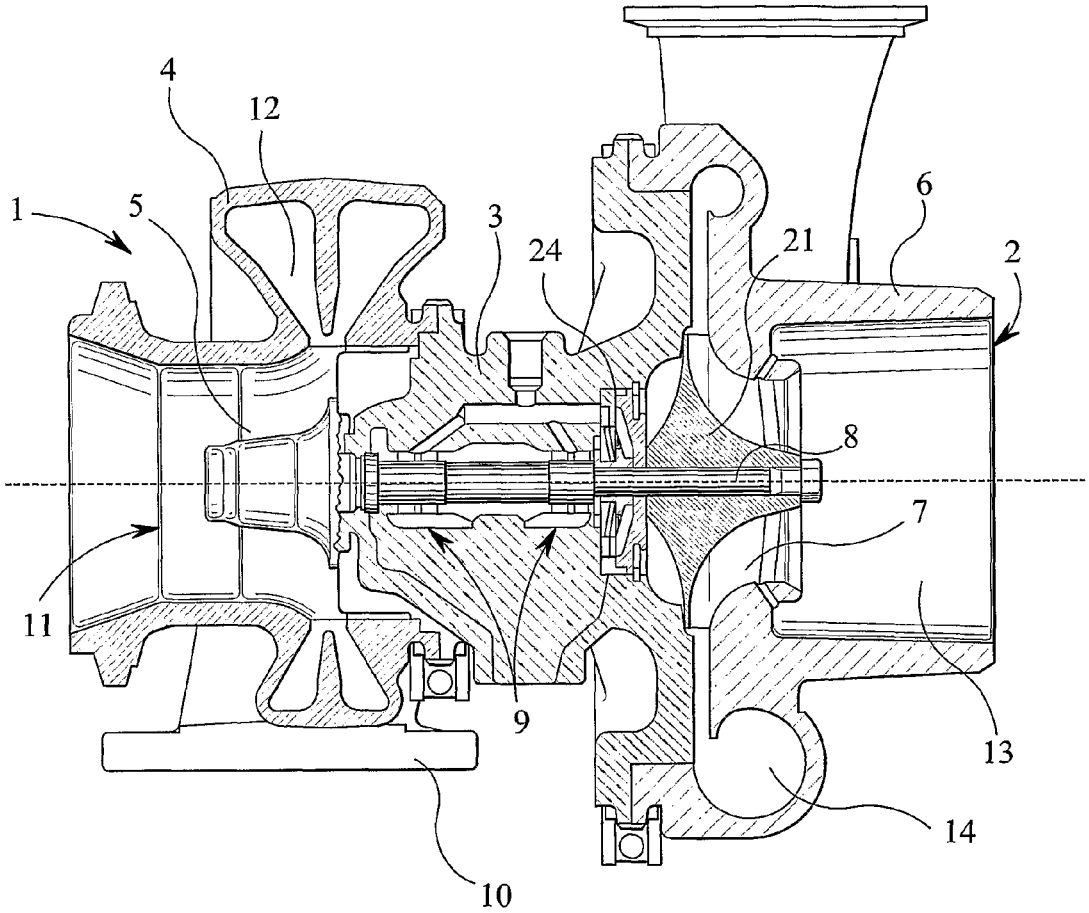
FIG. 1 is an axial cross-section through a conventional turbocharger illustrating the major components of a turbocharger and a conventional compressor wheel assembly.

Referring first to FIG. 1, this illustrates the basic components of a conventional centripetal type turbocharger. The turbocharger comprises a turbine 1 joined to a compressor 2 via a central bearing housing 3. The turbine 1 comprises a turbine housing 4 which houses a turbine wheel 5. Similarly, the compressor 2 comprises a compressor housing 6 which houses a compressor wheel 7. The turbine wheel 5 and compressor wheel 7 are mounted on opposite ends of a common shaft 8 which is supported on bearing assemblies 9 within the bearing housing 3.

The turbine housing 4 is provided with an exhaust gas inlet 10 and an exhaust gas outlet 11. The inlet 10 directs incoming exhaust gas to an annular inlet chamber 12 surrounding the turbine wheel 5. The exhaust gas flows through the turbine and into the outlet 11 via a circular outlet opening which is co-axial with the turbine wheel 5. Rotation of the turbine wheel 5 rotates the compressor wheel 7 which draws in air through axial inlet 13 and delivers compressed air to the engine intake via an annular outlet volute 14.

Figure 2:
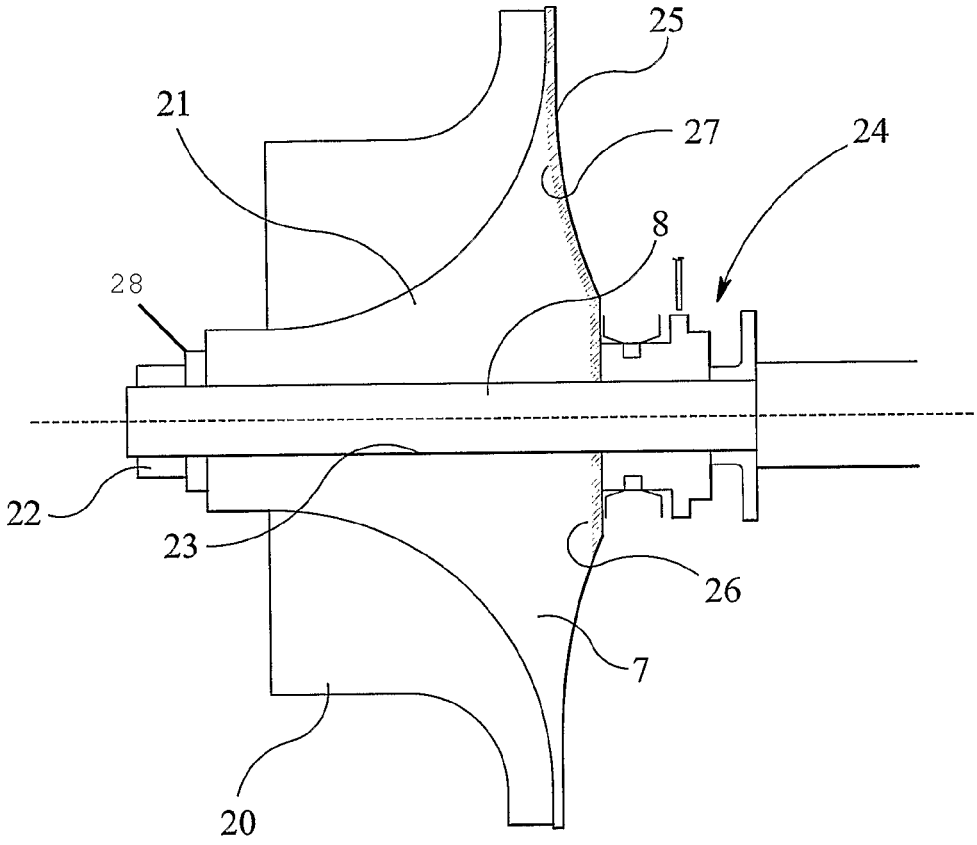
FIG. 2 is a cross-section through a compressor wheel assembly in accordance with the preferred embodiment.

Referring in more detail to the compressor wheel assembly, as shown in FIGS. 1 and 2, the compressor wheel comprises a plurality of blades 20 extending from a central hub 21 which is provided with a through bore 23 to receive one end of the shaft 8. The compressor includes a backface 25 which may be provided with a machined profile. The profile of the backface is designed to optimise the stress conditions in the compressor.

The shaft 8 extends slightly from the nose of the turbine wheel 7 and is threaded to receive a nut 22 which bears against the compressor wheel nose 28 to clamp the compressor wheel 7 against a thrust bearing and oil seal assembly 24. Alternatively the compressor wheel may be a so called 'bore-less' compressor wheel such as disclosed in U.S. Pat. No. 4,705,463. With this compressor wheel assembly only a relatively short threaded bore is provided in the compressor wheel to receive the threaded-end of a shortened turbocharger shaft. Details of the thrust bearing/oil seal assembly may vary and are not important to understanding of the present invention. Essentially, the compressor wheel 7 is prevented from slipping on the shaft 8 by the clamping force applied by the nut 17.

In accordance with the preferred embodiment a layer of residual compressive stress is created in at least a portion of the compressor wheel backface in order to reduce the occurrence of early life failures initiating at this relatively low stressed region of the wheel.

In some embodiments the layer of compressive residual stress 27 is formed so as to cover substantially the entire backface 25. However, in other embodiments it may be sufficient to only form a layer of compressive residual stress 26 to cover the region of the backface 25 which, in use, comes into contact with the thrust bearing and oil seal assembly 24. Such embodiments may be preferred to overcome the failure of the compressor wheel at the slinger interface region. With reference to FIG. 3, the applicant has noted that the slinger 24 appears to form a slight indent on the backface and a crack 30 is then initiated at the outside diameter of the indent. The crack appears to initially form as a circumferential crack in the backface that is caused to penetrate forwards into the impeller due to the applied radial stresses with the crack propagating parallel to the compressor bore. As hoop stresses become dominant the crack changes direction and the crack propagates in the radial direction until a resulting fracture occurs. The applicant has found that upon final fracture occurring the compressor wheel splits into two or more (typically three) generally similar sized pieces.

Several ways of inducing a layer of residual compressive stress have been disclosed for providing increased fatigue life and reduced susceptibility to corrosion-fatigue and stress corrosion. As mentioned above, these methods may be used to provide the layer of residual compressive stress required by the present invention. It will be appreciated that the present invention is not limited to any particular method and the layer of residual compressive stress may be formed when manufacturing the compressor wheel or by subsequently applying a separate process such as either thermal working or cold working techniques.

Burnishing is a commonly used cold working technique in which at least one element of a burnishing assembly is pressed against a work piece with sufficient force so as to deform the surface of the material by cold working (or plastic deformation). The deformation of the surface produces the desired layer of residual compressive stress. In most conventional techniques the work piece will be deformed several times by multiple passes of the burnishing element(s). Roller burnishing utilises at least one roller ball or bar as the burnishing assembly element. The burnishing process is controlled by a control system so that the movement of the burnishing element can match the three-dimensional profile of the work piece and control the applied rolling force.

The force applied during burnishing influences the resultant residual stress layer formation and must, therefore, be carefully controlled. Known burnishing tools may be either mechanical or hydrostatic tools. In a mechanical tool the rolling force may be set at a pre-determined level using a pre-load spring. In a hydrostatic tool the fluid pressure setting controls the rolling force.

Roller burnishing is considered particularly suitable for use in the present invention. Two specific roller burnishing techniques are "Low Plasticity Burnishing", as disclosed in U.S. Pat. No. 5,826,453, and "Deep Rolling", as disclosed in U.S. Pat. No. 6,755,065. Cold working techniques such as shot peening typically create a residual compressive stress layer to a depth of around 200 μm whereas these roller burnishing techniques advantageously produce a relatively deep layer to a depth of 800 μm or in some cases greater than 1 mm. These techniques are also considered preferable as they minimise the amount of cold working required.

By way of example, Low Plasticity Burnishing utilises a smooth free rolling spherical tool to make only a single pass with a normal force just sufficient to deform the material to the desired depth for forming the layer of residual stress. With reference to FIG. 4, the tool of the burnishing apparatus comprises a tip member 40 having a burnishing ball 41 disposed within a ball seat 42. Lubrication fluid 44 from an external reservoir is provided directly to the ball seat 42 with sufficient pressure to lift the ball off the surface of the ball seat to permit the burnishing ball to freely rotate, while also providing lubrication fluid to the surface of the work piece 50. The normal force, pressure and tool position are computer controlled to provide the desired regions and magnitudes of residual compressive stress.

Other possible modifications will be readily apparent to the skilled person.

The invention claimed is:

1. A compressor wheel, the compressor wheel having an axis of rotation and comprising a plurality of blades extending generally radially away from said axis and generally axially from one face of a disc-like support, the opposite face of the support defining a wheel backface, wherein at least a portion of the backface is provided with a layer of residual compressive stress extending to a depth below the surface of the backface.

2. A compressor wheel according to claim 1, wherein said backface portion is annular.

3. A compressor wheel according to claim 2, wherein said backface portion extends radially from the axis of the compressor wheel.

4. A compressor wheel according to claim 1, wherein said portion of the surface of the backface is less than an entire portion of the surface of the backface.

5. A compressor wheel according to claim 1, wherein the entire backface is provided with a layer of residual compressive stress.

6. A compressor wheel according to claim 1, wherein the layer of residual compressive stress has a maximum depth of at least 300 μm.

7. A compressor wheel according to claim 1, wherein said layer of residual compressive stress has a minimum depth of 300 μm.

8. A compressor wheel according to claim 1, wherein said layer of residual compressive stress has a maximum depth of at least 500 μm.

9. A compressor wheel according to claim 1, wherein said layer of residual compressive stress has a minimum depth of at least 500 μm.

10. A compressor wheel according to claim 1, wherein said layer of residual compressive stress has a maximum depth of at least 800 μm.

11. A compressor wheel according to claim 1, wherein said layer of residual compressive stress has a minimum depth of at least 800 μm.

12. A compressor wheel according to claim 1, wherein said layer of residual compressive stress has a maximum depth of at least 1 mm.

13. A compressor wheel according to claim 1, wherein said layer of residual compressive stress has a minimum depth of at least 1 mm.

14. A compressor wheel according to claim 1, wherein the depth of the layer of residual compressive stress varies across said portion of the surface of the backface.

15. A compressor wheel according to claim 14, wherein said depth is minimised in regions of said portion of the backface susceptible to deformation under compressive forces required to produce said layer of compressive stress.

16. A compressor wheel according to claim 1, wherein said layer of residual compressive stress is induced by applying a cold working technique to said portion of the backface.

17. A compressor wheel according to claim 16, wherein said cold working technique comprises roller burnishing.

18. A compressor wheel assembly comprising:

a compressor wheel having an axis of rotation and comprising a plurality of blades extending generally radially away from said axis and generally axially from one face of a disc-like support, the opposite face of the support defining a wheel backface, wherein at least a portion of the backface is provided with a layer of residual compressive stress extending to a depth below the surface of the backface.

19. A compressor wheel assembly according to claim 18, wherein a second member is mounted to the shaft for rotation therewith in abutment with a region of the wheel backface, and wherein said portion of the wheel comprising said layer of residual compressive stress includes at least said region.

20. A compressor wheel assembly according to claim 19, wherein said second member comprises an oil control device.

21. A compressor wheel assembly according to claim 19, wherein said second member comprises a component of a thrust bearing assembly mounted on said shaft.

22. A compressor wheel assembly according to claim 18, wherein the compressor wheel is welded to said shaft, a transition region being formed between the backface and shaft in the region of said weld, said transition region comprising said layer of compressive residual stress.

23. A compressor wheel assembly, comprising a compressor wheel welded to a shaft for rotation about an axis, the compressor wheel comprising a plurality of blades extending generally radially away from said axis and generally axially from one face of a disc-like support, the opposite face of the support defining a wheel backface, wherein a transition region is defined between the backface and shaft in the region of said weld, said transition region being provided with a layer of residual compressive stress extending the depth below the surface of the backface.

24. A turbocharger comprising a compressor wheel having an axis of rotation and comprising a plurality of blades extending generally radially away from said axis and generally axially from one face of a disc-like support, the opposite face of the support defining a wheel backface, wherein at least a portion of the backface is provided with a layer of residual compressive stress extending to a depth below the surface of the backface.

25. A method of manufacturing a compressor wheel to provide increased resistance to critical failure, the compressor wheel having an axis of rotation and comprising a plurality of blades extending generally radially away from said axis and generally axially from one face of a disclike support, the opposite face of the support defining a wheel backface, wherein at least a portion of the backface is treated to form a layer of residual compressive stress extending to a depth below the surface of the backface.

26. A method according to claim 25, wherein said treatment comprises applying a cold working technique to said portion of the backface.

27. A method according to claim 26, wherein said cold working technique comprises roller burnishing.

28. A turbocharger comprising a compressor wheel welded to a shaft for rotation about an axis, the compressor wheel comprising a plurality of blades extending generally radially away from said axis and generally axially from one face of a disc-like support, the opposite face of the support defining a wheel backface, wherein a transition region is defined between the backface and shaft in the region of said weld, said transition region being provided with a layer of residual compressive stress extending the depth below the surface of the backface.

29. A method of manufacturing a compressor wheel assembly comprising:

welding a compressor wheel to a shaft for rotation about an axis, the compressor wheel comprising a plurality of blades extending generally radially away from said axis and generally axially from one face of a disc-like support, the opposite face of the support defining a wheel backface, wherein a transition region is defined between the backface and shaft in the region of said weld; and treating said transition region to form a layer of residual compressive stress extending the depth below the surface of the backface.

* * * * *